US005387761A

United States Patent [19]

Simonis

[11] Patent Number: 5,387,761

[45] Date of Patent: Feb. 7, 1995

[54] SAFETY ELECTRICAL RECEPTACLE ASSEMBLY

[76] Inventor: Andrew Simonis, 27 Old Middleville Rd., Newton, N.J. 07860

[21] Appl. No.: 57,283

[22] Filed: May 6, 1993

[51] Int. Cl.[6] ..... H01R 13/447

[52] U.S. Cl. ..... 174/67; 439/136

[58] Field of Search ..... 174/67; 220/242; 439/136

[56] References Cited

U.S. PATENT DOCUMENTS

| | | | |
|---|---|---|---|
| 746,580 | 12/1903 | Russell | 174/67 X |
| 891,263 | 6/1903 | Klein | 174/67 |
| 900,773 | 10/1908 | Patterson | 174/67 |
| 901,034 | 10/1908 | Patterson | 174/67 |
| 905,364 | 12/1908 | Raymond | 174/67 X |
| 2,154,159 | 4/1939 | Hamilton | 439/139 |
| 2,465,079 | 3/1949 | Fitzgerald | 200/50 A |
| 2,487,900 | 11/1949 | Sopher | 174/67 |
| 2,916,733 | 12/1959 | Hirsch | 174/67 X |
| 2,987,214 | 6/1961 | Radack | 220/242 |
| 3,491,327 | 1/1970 | Tait et al. | 439/135 |
| 3,950,055 | 4/1976 | Samuels et al. | 439/142 |
| 4,134,516 | 1/1979 | Sullo | 220/242 |
| 4,159,858 | 7/1979 | Toraya | 174/67 X |
| 4,228,317 | 10/1980 | Cziment | 174/67 |
| 4,660,912 | 4/1987 | Tomek | 439/144 |
| 4,803,307 | 2/1989 | Shotey | 174/67 |
| 4,874,906 | 10/1989 | Shotey | 174/67 |

*Primary Examiner*—Leo P. Picard
*Assistant Examiner*—David Tone
*Attorney, Agent, or Firm*—Nath, Amberly & Associates

[57] ABSTRACT

A safety electrical receptacle assembly has rectangular electrical box having an open front, a face plate covering the open front of the electrical box, and a cover plate. The face plate has a main body, at least one cutout in the main body for receiving an receptacle, and a rim projecting upwardly and outwardly from the main body to define a recessed area. The cover plate is dimensioned to fit tightly within the recessed area. The cover plate is hingedly connected to the rim so that it is pivotally moveable between a closed position is which the cover plate covers the receptacles and an open position in which receptacles are exposed.

5 Claims, 2 Drawing Sheets

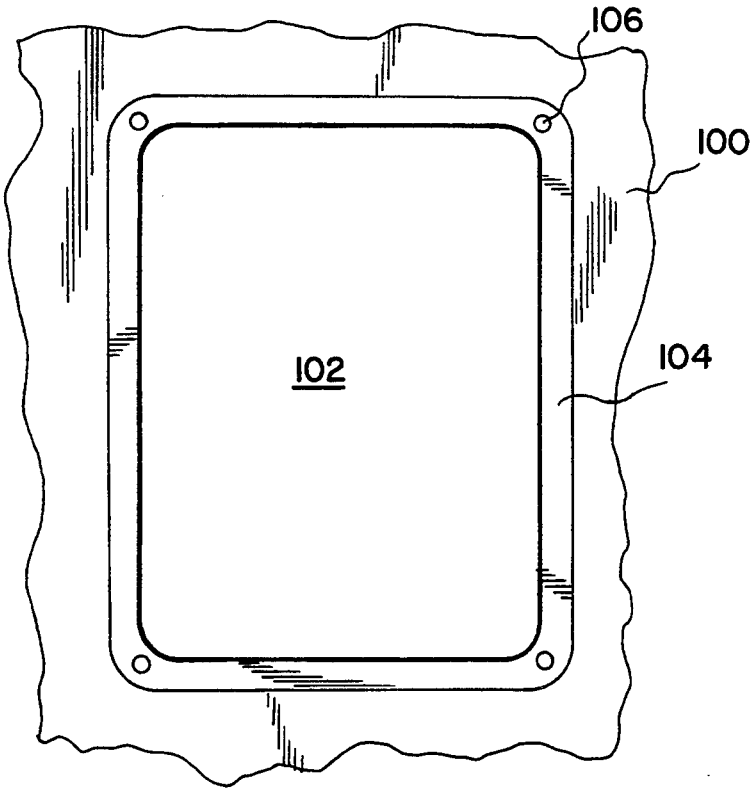
FIG. 4
FIG. 5
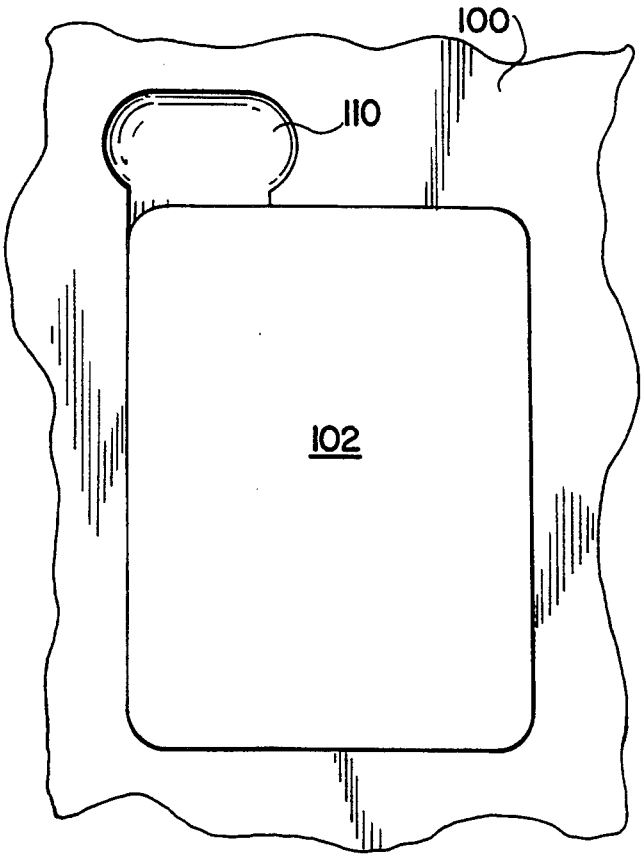

SAFETY ELECTRICAL RECEPTACLE ASSEMBLY

BACKGROUND OF THE INVENTION

1. FIELD OF THE INVENTION

This invention relates to electrical receptacles, and more particularly, to electrical receptacles which incorporate a plug cover, so as to meeting building codes for all kitchen applications.

2. DESCRIPTION OF THE INVENTION

It is common practice and is mandatory in electrical wiring of kitchens to install electrical receptacles on kitchen counter tops, peninsula, and islands. Such receptacles within six feet of a kitchen sink are mandatory to be installed on ground fault protection. Also mandatory in kitchen wiring is the installation of receptacles on the sides of islands and peninsula. These receptacles are not mandatory to be on ground fault and are usually mounted on the sides of the cabinets. The mounting location of these receptacles presents a potentially dangerous situation.

1. The height of the receptacle on the counter is readily accessible for a child to stick a foreign object into it, resulting in electrocution or being burned. Even with the safety plugs that are made for these receptacles, people do not always reinstall them when they are done using the device.
2. In order to use the receptacle on the side of the counter, an appliance cord must be plugged into the receptacle which leaves an electrical cord draped over the side. This again can result in a child grabbing the cord and pulling a hot pot on top of them. Furthermore, the possibility exists for a person passing by of catching the cord onto a loose coat or pocket book, or even backing up and catching the wire with one's hip.
3. Due to manufacturers and code changes, appliance cords must only be two feet long. This again increases the possibility of an accident because appliances will be close to the edge of the counter tops. Another problem with the location of the receptacle on counter tops is that counter tops have twelve inch and sixteen inch overhangs which bring the appliances even closer to the edge.
4. Due to the construction of cabinets, in many cases it is impossible to install receptacles on the island and peninsula. The result is the use of an extension cord.

To date, there are no electrical devices available which solve these problems. Various types of covers for plug-in outlets, however, have been devised. U.S. Pat. No. 2,154,159 to P. E. Hamilton describes an electrical receptacle with rotatable discs adopted to fit over each of the outlets of the base, so that access to the contacts within the base can be had only by means of an attachment plug, and accidental shocks are thereby positively prevented.

U.S. Pat. No. 2,916,733 to Wilbert Hirsch pertains to a protective cover for an electrical receptacle which wholly conceals the receptacle and any plug which may be inserted therein. The protective cover is pivotally or slidably mounted on the face plate and provided with connector means for passing electrical cords through the cover.

U.S. Pat. No. 2,987,214 to H. E. Radack discloses a wall plate, a cover pivoted thereon, and a spring which is in embracing relation to the cover and plate, in such a manner as to hold the same assembled with each other, without requirement of any additional fastener or connector means. The spring constitutes a means for connecting the cover to the plate, a means for biasing the cover to its normal, closed position and an indexing means for releasably holding the cover in its open position.

U.S. Pat. No. 3,491,327 to T. Tait et. al. teaches a safety cover for electrical plug outlets that is a substantially rectangular box-shaped cover having the front, sides and top surfaces completely enclosed with a partially enclosed bottom surface and an elongated wall-facing opening, the wall-opening being provided with an inwardly expanding flange formed on each end of its longitudinal edges, each of the flanges being provided with a downwardly facing, inclined plane so that when the facing plate of the electrical outlet is loosened, and the safety cover is slid down into the position, the wedging force of the inclined plane between the wall and the back of the face plate will retighten the plate and firmly mount the cover thereto.

U.S. Pat. No. 4,660,912 to Lawrence S. Tomek involves a protective cover for an electrical outlet made up of a cover plate attachable to the existing receptacle plate and includes an opening aligned over each outlet in the plate and a unitary cap which is hinged to the cover along one side of each opening. The cap is movable into snap-fit engagement with a catch so as to serve as a protective cover over the outlet to prevent tampering and protect it from the elements. A latch release mechanism internally of the cap minimizes the risk of opening by infants, as well as making it weatherproof.

U.S. Pat. Nos. 4,803,307 and 4,874,906 to Michael J. Shotey disclose a weatherproof outlet cover that fits over an outdoor electric outlet and includes a mounting plate demountably secured to the outlet housing in place of a conventional face plate and a lid member mountably and pivotably mounted over the mounting plate, accommodating at least one electrical plug plugged into a receptacle in the outlet. At least one access slot is provided in the bottom of the lid member for enabling a corresponding number of electrical cords from the plugged in plugs to be extended there through. First, the sealing member is disposed between the mounting plate and the wall surrounding the outlet housing and the second sealing member is disposed between the lid member and the mounting plate to prevent foreign matter from entering the outlet.

U.S. Pat. No. 2,465,079 to George E. Fitzgerald discloses a safety cover for a fused switch. An opening and closing of this cover served to cut the fuse out of and into circuit.

U.S. Pat. No. 2,487,900 to J. U. Sopher teaches a guard for attachment to a wall-receptacle that includes an electric plug-socket, a casing having a real wall that has means to secure it to a wall-receptacle and has an opening there through to permit an electrical plug-body to extend there through while the plug-contacts are engaged with their complimented contacts in an electric circuit. The guard plate entirely covers the opening of the rear wall when the plug is absent from the plug socket.

U.S. Pat. No. 3,950,055 to Allen J. Samuels relates to a threaded cover pivotally secured to a strap that is hinged to the base of the cover plate, the strap and base having cooperative means for holding the cover in an up position away from the access part to the receptacle merely by raising the strap to a position substantially perpendicular from the face, such as by the strap being L-shaped with a loop in the lack of the L encircling a pin secured to the face with the loop being shaped to slide over the pin when the cover is raised and to veer against the face in a locked open position.

U.S. Pat. NO. 4,134,516 to Kenneth J. Sullo pertains to a spring-loaded, hinged cover of a weatherproof outlet box.

U.S. Pat. No. 4,334,630 to Paul F. Bergin discloses a hatch for attachment to a wall which includes a face, a cover, interlocking pegs, and grooves for securing the cover to the base.

While several attempts have been made to provide outlet receptacles with protective covers, these devices have all been ineffective to meet the safety requirements of building codes, and frequently involve an excessive number of parts and an excessive number of assembly steps. For some of the devices, in order to insert an electrical plug into the outlet, the cover has to be totally removed from the outlet and is therefore easy to lose.

The purpose of the present device is to allow safe useable electrical receptacles on top of a counter. In this way, the receptacles are installed on ground fault, which is mandatory under current U.S. building codes; it eliminates a child safety hazard; it eliminates cords hanging over the counters; it enables receptacles to meet electrical codes on all counter tops; and it enables the presence of a cover that will close after each use of the receptacle.

SUMMARY OF THE INVENTION

Briefly, the safety electrical receptacle of the present invention is readily conformable for use with various installations and especially central kitchen islands or table tops wherein water or other foreign elements have heretofore prevented their use. For the purpose of illustration but not limitation there is shown in FIGS. 1 to 3 a standard duplex outlet having a pair of electrical plug-receiving receptacles in connected relation to one another. The outlet is mounted in an electrical box which is positioned in an aperture in a support surface with terminals on the outlet connected to the main wiring. Each receptacle has a prong-receiving recess for insertion of the prongs of an electrical plug so as to establish direct contact with the wiring.

In accordance with the present invention there has been devised a safety electrical receptacle comprising a rectangular shaped electrical box tightly fitting into an aperture in a supporting surface, such as a baseboard or counter top. The electrical box has an open front to receive a conventional electrical outlet and an access slot on one side to permit an electrical cable to be connected to the outlet. A continuous marginal flange extends perpendicular to the sides for registration with a recess surrounding the aperture in the supporting surface.

A face plate is releasably connected to and fully covers the open front of the electrical box so as to form an integral unit with the electrical box. Two cut-outs are provided on the face plate in conventional fashion to receive the receptacles of the outlet. A peripheral rim extends outwardly and upwardly from the main body of the face plate to define a central recessed area.

A cover plate is dimensioned to tightly fit within the recessed area circumvented by the peripheral rim. The cover plate is hinged to the peripheral rim of the face plate so as to be movable from a closed position covering the outlet to an open position in which the outlet is exposed. The face plate, the cover plate, and the electrical box constitute a closed compartment when the cover plate is in its closed position.

BRIEF DESCRIPTION OF THE DRAWINGS

FIG. 4 is a front elevational view of a supporting surface for the safety electrical receptacle of FIG. 1; and FIG. 5 is a rear elevational view of the supporting surface of FIG. 4.

DETAILED DESCRIPTION OF THE PREFERRED EMBODIMENTS

Figure 1:
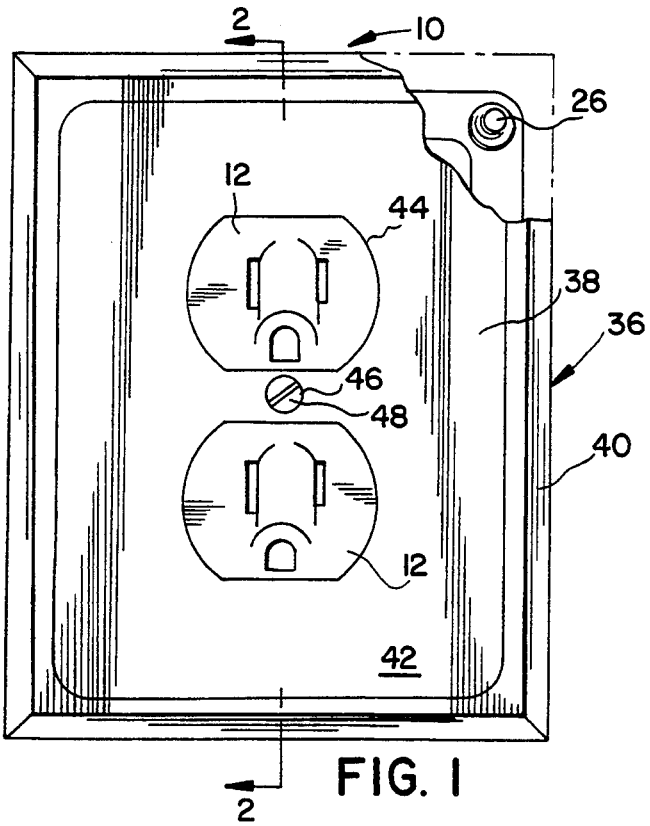
FIG. 1 is a front elevational view of a safety electrical receptacle in accordance with the present invention, with the cover plate partially broken away, and with the upper right corner broken away to show the underlying structure.
Figure 2:
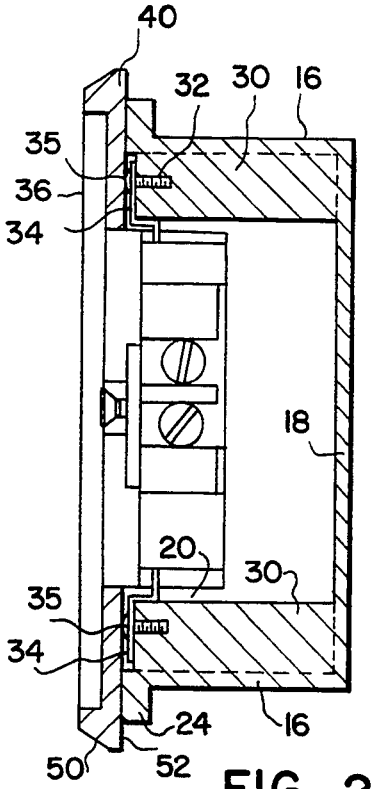
FIG. 2 is a cross-sectional view taken along line 2—2 of FIG. 1.
Figure 3:
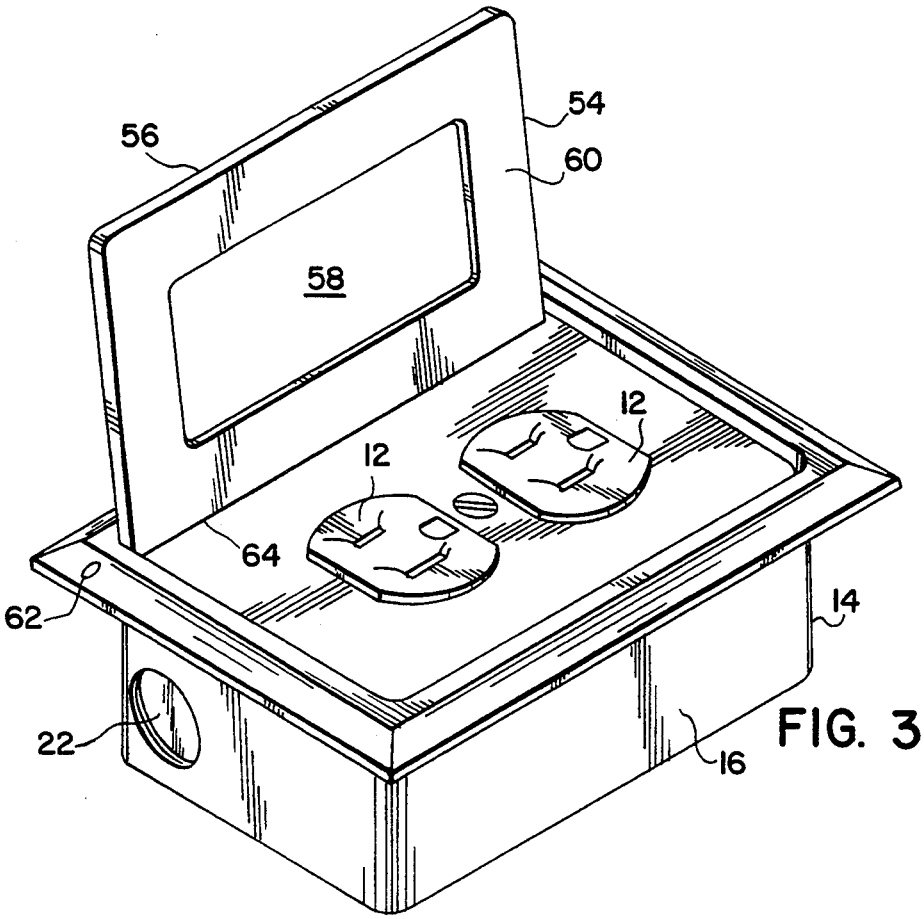
FIG. 3 is a perspective view of the safety electrical receptacle of FIG. 1 with the cover plate being in open position to expose a duplex outlet.

Referring particularly to the drawings, there is shown in FIGS. 1–3 a safety electrical receptacle 10 in accordance with the present invention. As best shown in FIG. 2, receptacle 10 comprises a pair of conventional electrical outlets 12 within an electrical box 14.

Electrical box 14 is a substantially rectangular-shaped box having closed sides 16, a closed back 18, and an open front 20 (FIG. 2). An access aperture 22 is provided in one of sides 16 to permit insertion of an electrical cable for connection in a conventional manner with outlets 12. A continuous marginal flange 24 extends perpendicularly outwardly from the front edges of sides 16. Countersunk holes 26 are provided at the four corners of flange 24 for a purpose to be described hereinafter.

Two pillars 30 extend inwardly from the inner surfaces of opposite sides 16 of electrical box 14 and are provided with internally threaded bores 32. Ears 34 fit over pillars 30, enabling pillars 30 and ears 34 to be secured together by screws 35 in a releasable manner. Bores 32 are aligned with holes (not shown) conventionally provided in ears 34 extending outwardly from plugs 12.

A face plate 36 of generally rectangular configuration is affixed to the front of electrical box 14. Face plate 36 comprises a main body 38 having a flat upper surface, and a continuous marginal rim 40 projecting upwardly and outwardly from main body 38 to define a recess 42. A pair of cut-outs 44 are conventionally provided in main body 38 for receiving outlets 12; while a small hole 46 is provided between the cut-outs 44 to receive a screw 48 for fastening face plate 36 to outlets 12. Marginal rim 40 has sloping sides 50, as well as a planar back surface 52 which bears against flange 24. The perimeter of rim 40 extends outwardly of the perimeter of flange 24, for a purpose to be described hereinafter. As can best be seen from FIG. 2, outlets 12 protrude slightly from face plate 36 in conventional fashion.

As shown in FIG. 3, cover plate 54 is dimensioned to fit tightly in recess 42. Cover plate 54 has a planar outer surface 56 to present a generally continuous surface with rim 40 when in the closed position, and a recess 58 in its inner surface 60 for receiving protruding outlets 12, also when in the closed position. A pair of aligned pintles or rivets 62 hinges cover plate 54 to rim 40 so that cover plate 54 is pivotally movable from a closed position in which it covers receptacles 10, to an open position in which receptacles 10 are exposed. Hinged edge 64 of cover plate 54 is of reduced thickness to enable cover plate 54 to pivot about pintles 62 without interference.

Electrical box 11, face plate 36, and cover plate 54 can be simply and inexpensively made from metal, heavy duty plastic, or any other suitable material for use in an electrical receptacle assembly. When assembled, they provide with outlets 12 an essentially closed, integral unit.

As illustrated in FIGS. 4 and 5, a support surface 100 such as a baseboard, a cabinet side, or a countertop is provided with a generally rectangular aperture 102 for receiving sides 16 of electrical box 14. Aperture 102 is dimensioned to receive sides 16 without gaps. A recess 104 is formed in the outwardly facing surface of base board 30 around aperture 102 for registration with flange 24. The portion of back surface 52 of rim 40 which extends beyond flange 24 bears against support surface 100 outwardly of recess 104. In this way, a continuous surface is provided between support surface 100 and electrical box 14, with no gaps or openings. Bores 106 are formed at the corners of recess 104 in registration with holes 26 for receiving screws (not shown) for releasably securing safety receptacle 10 to support surface 100. A notch 110 also is provided in the inwardly facing surface of base board 30, and is aligned with access aperture 22 in order to accommodate a conventional collar for placement in registration with aperture 22 to receive the electrical cable.

It is therefore to be understood that while the preferred and alternate forms of the present invention have been herein set forth and described, various modifications and changes may be made in the construction and arrangement of parts thereof without departing from the spirit of the present invention as defined by the attached claims. For example, while a receptacle assembly having two outlets has been shown and described, it is of course to be understood that this is merely for the purpose of illustration and that a greater number of outlets can be employed if desired. It is also possible to split the cover plate, so as to provide a single cover for each receptacle, so that one receptacle can be in use while the other is still protected by an overlying cover in its closed position against the face plate.

The invention being thus described, it will be obvious that the same may be varied in many ways. Such variations are not to be regarded as a departure from the spirit and scope of the invention and all such modifications are intended to be included within the scope of the following claims.

What is claimed is:

1. A safety electrical receptacle assembly comprising:

an electrical box having an open front, four closed sides, and a closed back, an access aperture in one of said closed sides for receiving an electrical cable, and a continuous marginal flange extending perpendicularly outwardly from said sides;

an electrical outlet housed in said electrical box, said outlet having at least one receptacle extending out of said open front of said electrical box;

a face plate covering said open front of said electrical box and overlapping said flange, said face plate having a main body, at least one cut-out in said main body for receiving at least one receptacle, and a rim projecting upwardly and outwardly from said main body to define a recessed area;

a cover plate dimensioned to fit tightly within said recessed area and hingedly connected to said rim for pivotable movement between a closed position in which said cover plate covers said receptacles and an open position in which said receptacles are exposed;

a supporting surface having a generally rectangular aperture for tightly receiving said electrical box;

said supporting surface further comprising an inwardly facing surface and an outwardly facing surface, said outwardly facing surface having a recess for recess for registration with said flange; and said inwardly facing surface having a notch aligned with said access aperture.

2. A safety electrical receptacle assembly, comprising:

an electrical box having an open front, four closed sides, and a closed back, an access aperture in one of said closed sides for receiving an electrical cable, and a continuous marginal flange extending perpendicularly outwardly from said sides;

a face plate covering said open front of said electrical box and overlapping said flange, said face plate having a main body, at least one cut-out in said main body for receiving at least one receptacle, and a rim projecting upwardly and outwardly from said main body to define a recessed area; and a cover plate dimensioned to fit tightly within said recessed area and hingedly connected to said rim for pivotable movement between a closed position in which said cover plate covers said receptacles and an open position in which said receptacles are exposed;

a supporting surface having a generally rectangular aperture for tightly receiving said electrical box; and said inwardly facing surface having a notch aligned with said access aperture.

3. A safety electrical receptacle assembly, of claim 2: wherein said cover plate further comprising a hinged end having a reduced thickness.

4. A safety electrical receptacle assembly, comprising:

an electrical box having an open front, four closed sides, and a closed back, an access aperture in one of said closed sides for receiving an electrical cable, and a continuous marginal flange extending perpendicularly outwardly from said sides;

a face plate covering said open front of said electrical box and overlapping said flange, said face plate having at least one cut-out for receiving at least one receptacle;

a cover plate hingedly connected to said face plate for pivotable movement between a closed position in which said cover plate covers said receptacles and an open position in which said receptacles are exposed;

a supporting surface having a generally rectangular aperture for tightly receiving said electrical box; and said inwardly facing surface having a notch aligned with said access aperture.

5. A safety electrical receptacle assembly of claim 4, wherein said cover plate further comprising a hinged end having a reduced thickness.

* * * * *